US005395106A

United States Patent [19]

Tohnai et al.

[11] Patent Number: 5,395,106

[45] Date of Patent: Mar. 7, 1995

[54] SHEET FORWARDING APPARATUS FOR DETERMINING CAUSES OF FEEDING DEFECTS

[75] Inventors: Yoshihiro Tohnai; Shigeo Kurando; Yukio Hashimoto; Hiroyuki Tsuji; Hidekazu Sakagami, all of Osaka, Japan

[73] Assignee: Mita Industrial Co., Ltd., Japan

[21] Appl. No.: 151,117

[22] Filed: Nov. 12, 1993

[30] Foreign Application Priority Data

Nov. 19, 1992 [JP] Japan ..... 4-310209

[51] Int. Cl.[6] ..... B65H 7/02

[52] U.S. Cl. ..... 271/258; 271/109; 355/206; 355/308

[58] Field of Search ..... 271/9, 109–111, 271/258, 259; 355/206, 209, 308

[56] References Cited

U.S. PATENT DOCUMENTS

| | | | |
|---|---|---|---|
| 4,589,765 | 5/1986 | Perun et al. | 355/3 SH |
| 4,860,052 | 8/1989 | Ito et al. | 355/209 |
| 4,985,729 | 1/1991 | Sampath et al. | 355/308 X |
| 5,200,779 | 4/1993 | Nawata | 355/209 X |

FOREIGN PATENT DOCUMENTS

| | | | |
|---|---|---|---|
| 219571 | 12/1983 | Japan | 355/308 |
| 38229 | 2/1990 | Japan | 271/258 |
| 284961 | 12/1991 | Japan | 271/258 |
| 32442 | 2/1992 | Japan | 271/258 |
| 43620 | 7/1993 | Japan . | |

OTHER PUBLICATIONS

Bessette, M. D., "Designing reliable paper-handling systems", Machine Design (1985), vol. 57, pp. 54–58.

*Primary Examiner*—Robert P. Olszewski
*Assistant Examiner*—Boris Milef
*Attorney, Agent, or Firm*—Beveridge, DeGrandi, Weilacher & Young

[57] ABSTRACT

A sheet feeding unit includes a sheet forwarding unit for forwarding sheets from a sheet storing unit, a key input portion, a sheet detection gate, and a control unit. In one embodiment, the sheet forwarding unit repetitively performs its function after an operation start instruction until either the sheet detection gate detects a sheet from the feeding cassette or until the number of repetitions of the sheet forwarding unit reaches a predetermined number. An error process is performed when the number of repetition reaches the predetermined number without the gate detecting a sheet. Also, the sheet feeding unit compares the number of times a sheet is fed from the sheet feeding unit with the number of times the sheet if forwarding to determine the status of the feeding roller.

22 Claims, 7 Drawing Sheets

SHEET FORWARDING APPARATUS FOR DETERMINING CAUSES OF FEEDING DEFECTS

BACKGROUND OF THE INVENTION

The present invention relates to a sheet feeding apparatus and more specifically, to a sheet feeding apparatus for an image forming apparatus, which feeds a sheet one by one from a stack of sheets to an image forming unit of an image forming apparatus.

In the image forming apparatus such as a copying machine, there is provided a sheet feeding apparatus which includes a feeding cassette, a sheet forwarding unit for forwarding a sheet one by one from the feeding cassette to the image forming unit, and a sheet detection gate for detecting whether the sheet is actually forwarded from the sheet forwarding unit or not. The sheet forwarding unit includes a feeding roller abutting on an uppermost sheet in the feeding cassette, and a pair of upper and lower separating rollers.

According to conventional devices like the above sheet feeding apparatus, when the print key of the copying machine is pressed, the feeding roller abutting on a selected sheet starts to rotate at a predetermined timing. Then, a sheet separated by the separating rollers passes through a sheet detection gate and is then supplied to the image forming unit.

In the above example, if the detection gate does not detect the sheet even after a predetermined time has elapsed from the start of the forwarding operation, it is determined that sheet-feeding defect has generated in the sheet forwarding unit due to a paper jam. Then this fact is displayed at the operation panel, whereupon tile operation of tile machine is halted. In order to start the operation again, the jammed sheet is taken out, the sheets in the feeding cassette are aligned, and the reset switch is pressed.

According to the above conventional structure, the operation has to be restarted each time, when the detection gate does not detect tile sheet within a predetermined time, resulting in a determination that the paper is jammed thus halting operation.

However, feeding defects are not only caused by the paper jam but may also be caused by wear of the feeding roller. When the feeding defect is caused by the wear of the feeding roller, the sheet can be supplied in many cases simply by repeating the feeding operations several times.

The above conventional structure, however, can not determine the cause of the feeding defect. Consequently, a feeding defect detected even once is determined to be a paper jam and hence the machine is immediately stopped. Therefore, conventional machines may be often unnecessarily halted due to feeding defects caused by the wear of the feeding roller, although these defects would easily be resolved by just repeating the feeding operation.

Japanese Patent Publication No. 43620/1993 discloses a jam-check means for a sheet transport apparatus which includes a first counter which counts the number of times sheets are transported, and second counters which each count the number of jams occurring at certain jam locations. This jam-check means sends out a warning when a number of jam occurrences exceeds a predetermined value in any of the jam locations. Thus, discovery of the problem area becomes much easier. However, it does not distinguish between supply forwarding failures due to jamming and those due to a worn supply roller.

SUMMARY OF THE INVENTION

It is an object of the present invention to prevent unnecessary halting of a machine when a feeding defect is generated due to a worn roller.

It is another object of the present invention to readily determine a cause of the feeding defect.

A sheet feeding apparatus according to a first aspect of the present invention feeds a sheet one by one from a stack of sheets to an image forming unit of an image forming apparatus. When the start instruction is input, the sheets stored in a feeding cassette are forwarded to the image forming unit one by one. Therein, the sheet-forwarding operation is repeated a predetermined number of times after the start instruction until it is detected that the sheet is actually forwarded from the feeding cassette.

In the case of a feeding defect caused by wear of a sheet-forwarding part, the sheet is usually forwarded without error just by repeating the forwarding operation, and the machine need not be unnecessarily halted. Meanwhile, if the sheet forwarding is not detected even after the forwarding operation is repeated the predetermined number of times, an error process is performed.

A sheet feeding apparatus according to a second aspect of the present invention feeds a sheet one by one from a stack of sheets to an image forming unit of an image forming apparatus. Therein, when the sheet is supplied from a sheet storage to the image forming unit one by one, the number of sheet-forwarding operations is counted. In addition, it is detected whether the sheet is forwarded from the sheet storage or not, and the number of times the sheet is detected is also counted.

Then, the state of the sheet-forwarding operation is determined by comparing the number of operations with the number of sheet-detected times. When the number of forwarding operations is considerably greater than the number of sheet-detected times, it is determined that the sheet-forwarding operation is defective. Thus, the cause of the feeding defect can be easily determined.

These and other objects and advantages of the present invention will be more fully apparent from the following detailed description.

DESCRIPTION OF THE PREFERRED EMBODIMENTS

Figure 1:
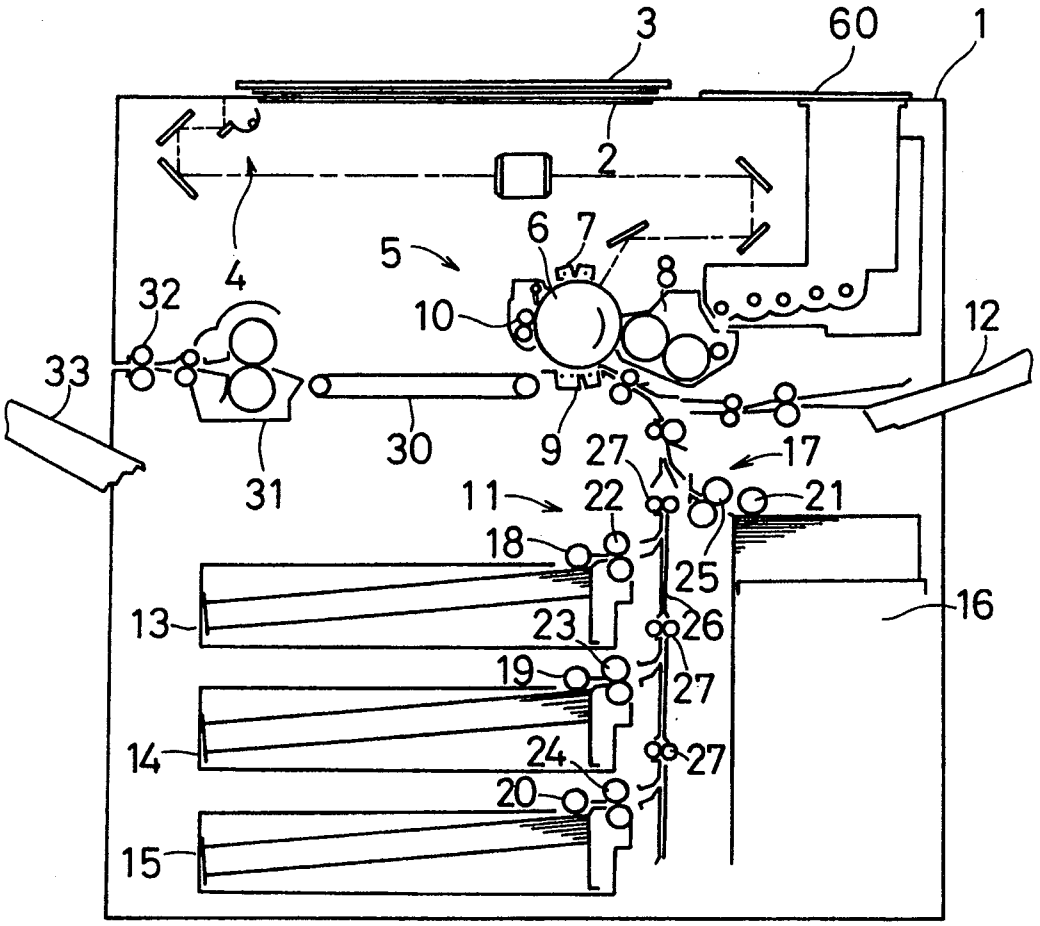
FIG. 1 is a vertical section view showing a copying machine according to an embodiment I of the present invention.

Referring to FIG. 1, a copying machine body 1 includes an original support 2 fitted in its upper surface, and an original cover 3 is openably disposed on the original support 2.

An optical exposure unit 4 for reading an original is provided in an upper portion of the interior of the copying machine body 1. The optical exposure unit 4 includes a light source, mirrors, a lens unit, and other associated elements. An image forming unit 5 for forming a toner-developed image from the original is provided in a central portion of the copying machine body 1. A photoconductive drum 6 on which an electrostatic latent image is formed is disposed in the image forming unit 5. A charger 7, an developing unit 8, a transfer separating unit 9, and a cleaning unit 10 are disposed surrounding the photoconductive drum 6.

A feeding unit 11 is provided under the copying machine body 1. The feeding unit 11 includes a bypass table 12 disposed on the right side of the copying machine body 1 in FIG. 1, three feeding cassettes 13, 14, and 15 vertically disposed under the copying machine body 1, a large feeding cassette 16 storing a great quantity of sheets, disposed adjacent and to the right of the feeding cassettes 13, 14, and 15 in the figure, and a sheet forwarding unit 17 for forwarding sheets stored in the bypass table 12 or the feeding cassettes 13 to 16 toward the image forming unit 5.

The sheet forwarding unit 17 includes feeding rollers 18 to 21 each of which feeds out an uppermost sheet from each of the feeding cassettes 13 to 16, separating roller pairs 22 to 25 each of which separates one sheet from other sheets, a vertical transport path 26 for guiding the sheet upward, and three pairs of guiding rollers 27 for transporting the sheet along the vertical transport path 26.

A discharge transport path 30 for transporting sheets toward the left side of the machine in FIG. 1, a fixing apparatus 31 for fixing the toner image on the sheet, a pair of discharge rollers 32, and a discharge tray 33 for receiving sheets are provided downstream of the image forming apparatus 5 in the sheet-transporting direction.

Since the feeding cassettes 13 to 16 have the same structure, only the feeding cassette 13 and its surrounding structure will be described.

Figure 2:
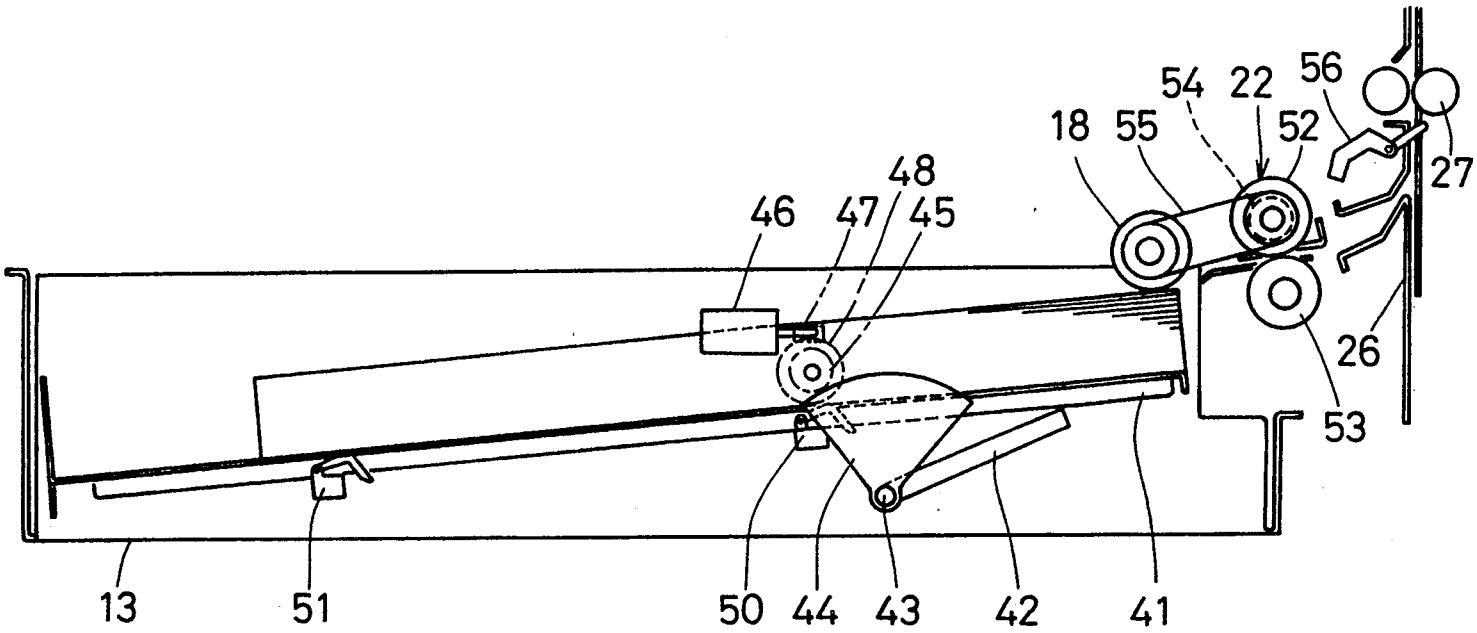
FIG. 2 is a vertical section view showing a feeding cassette and adjacent parts.

Referring to FIG. 2, a sheet retainer 41 for retaining sheets is provided in the feeding cassette 13. One end (right end in FIG. 2) of the sheet retainer 41 is vertically moved by a lifting member 42. A rod 43 is fixed to a bottom end of the lifting member 42. A section gear 44 is mounted to the rod 43 and a pinion 45 is engaged with the section gear 44. In the pinion 45 a worm wheel 48 is provided which is engaged with a worm 47 mounted to a rod of a lifting motor 46. Additionally, a switch 50 for detecting existence of the sheet and a feeler arm 51 for detecting a sheet size are provided onto the sheet retainer 41.

The separating roller pair includes a forward roller 52 and a reversal roller 53. A clutch 54 is mounted in the forward roller 52. The forward roller 52 and the feeding roller 18 are connected by a belt 55. When power is transmitted to the forward roller 52, it is transferred to the feeding roller 18 through the belt 55. A sheet detection gate 56 made of a trip switch is disposed in the lower detecting portion of the guiding roller 27 in the vertical transport path 26 for detecting whether the sheet is forwarded by the feeding roller 18 or not, in other words, whether a feeding defect is generated or not.

Figure 3:
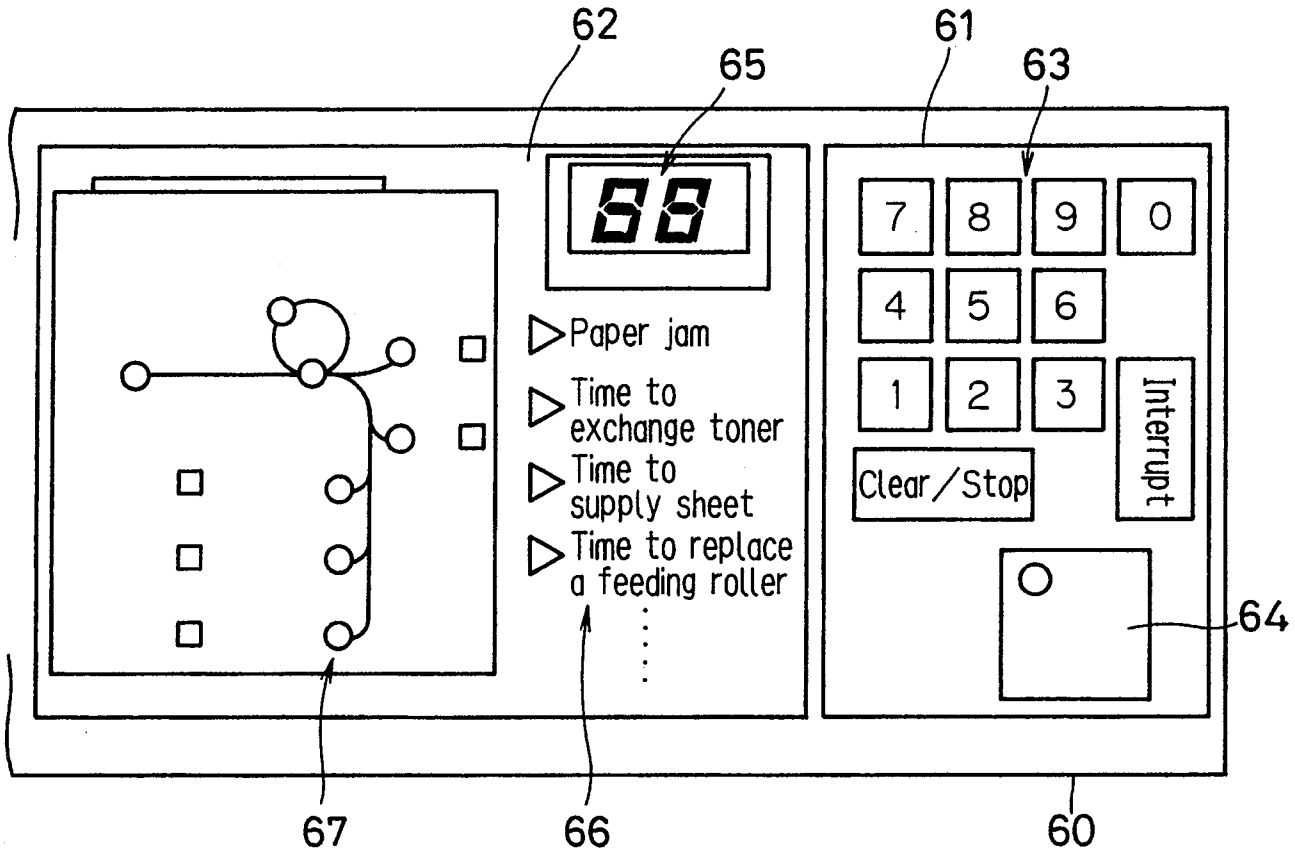
FIG. 3 is a plan partial view showing an operation panel.

An operation panel 60 is disposed in the upper portion of the copying machine body in FIG. 1. Referring to FIG. 3, the operation panel 60 includes a key input portion 61 and a display 62. In the key input portion 61, a ten-key board 63 and a print key 64 are disposed. The display 62 includes a numeral display 65 for displaying the number of copies or a code of a service man call; an LED display 66 for indicating the time when the operator should clear a paper jam, refill the toner, refill the paper, or replace the roller; and a position display 67 for displaying a position of a paper jam.

Figure 4:
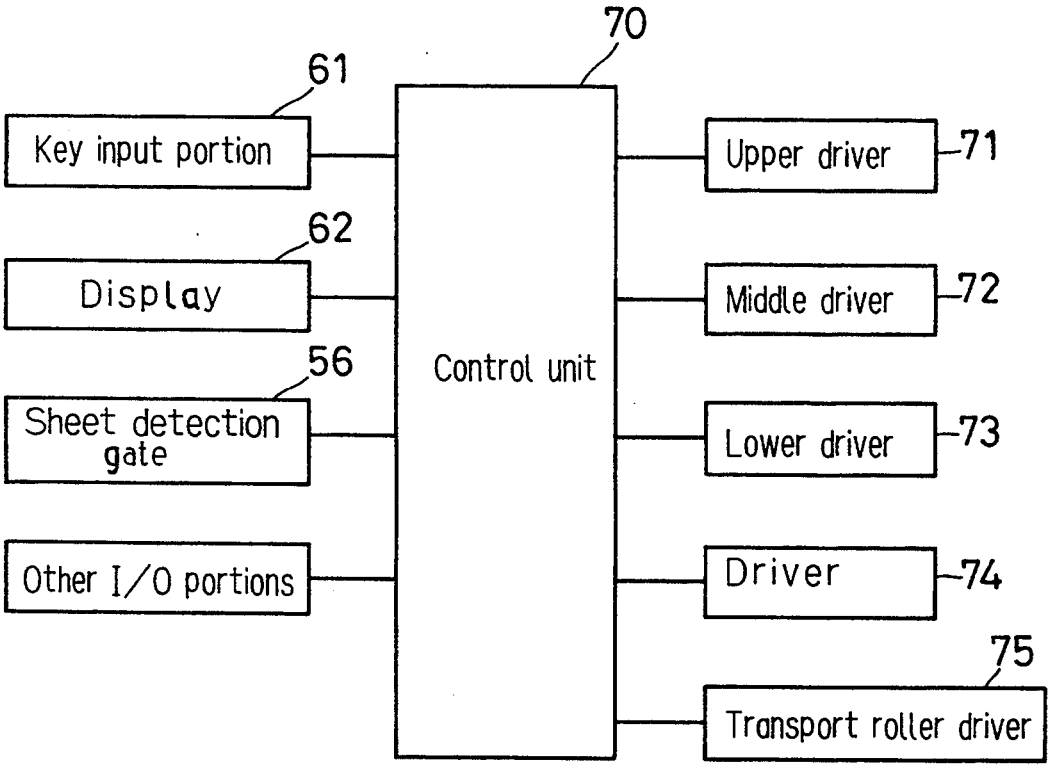
FIG. 4 is a block diagram of the copying machine.

In addition, the copying machine body 1 includes a control unit 70 shown in FIG. 4. The control unit 70 includes a microcomputer system including a CPU, a RAM, a ROM, several drivers, and several I/O portions. Upper driver 71 is connected to the control unit 70 for driving the feeding roller 18 and the separating roller pair 22 for the feeding cassette 13, a middle driver 72 is connected for the feeding cassette 14, a lower driver 73 is connected for the feeding cassette 15, and a driver 74 is connected for the large feeding cassette 16. The transport roller driver 75 is in contact with, for the purpose of driving, the feed rollers within the vertical transport path 26. In addition, to the control unit 70 are connected the key input portion 61 and the display 62 of the operation panel 60, the sheet detection gate 56, and other I/O portions.

Figure 5:
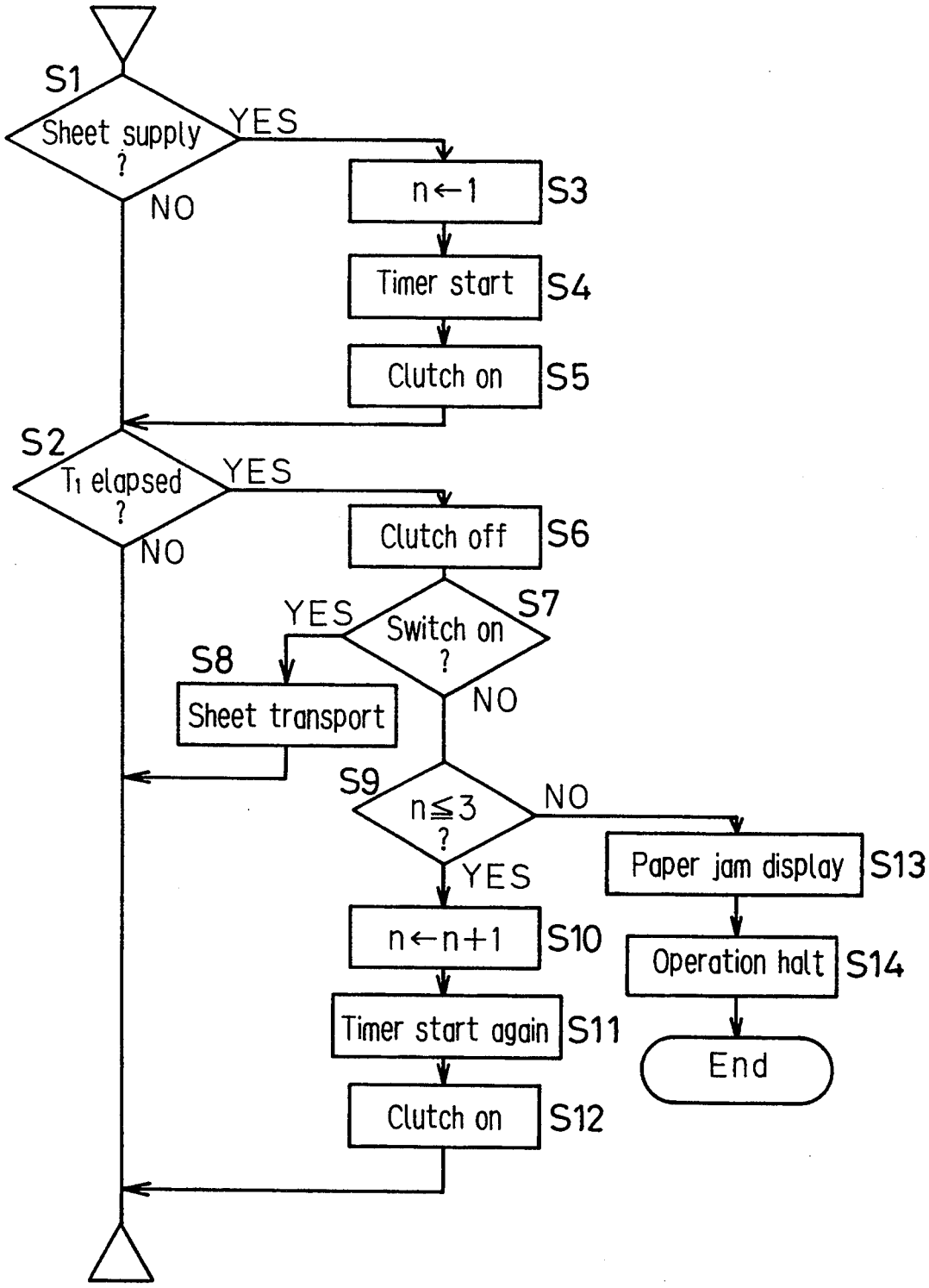
FIG. 5 is a control flowchart of the same.

The sheet-feeding operation according to the above embodiment of the present invention will be described according to a flowchart shown in FIG. 5. When the print key 64 of the operation panel 60 is pressed, a program shown in FIG. 5 is carried out.

It is determined at step S1 whether it is time to start sheet supply from the feeding cassette storing sheets of predetermined size or not. Then, it is determined at step S2 whether a predetermined time $T_1$ has elapsed from the start of sheet supply or not. The predetermined time $T_1$ is a time sufficient for the sheet to be transported from the feeding cassette to the guiding rollers 27 disposed downstream of the feeding cassette in the sheet-transporting direction.

When it is determined that it is time to start sheet supply, the program proceeds from step S1 to step S3. At step S3, a variable n showing the number of feeding operations is set to "1". At step S4, a timer for counting the predetermined time $T_1$ is started. At step S5, the clutch 54 for feeding the sheet from the specified cassette is turned on, whereupon the feeding roller 18 and the separating roller pair 22 are driven. Then, the program proceeds from step S5 to step S2.

When it is determined the predetermined time $T_1$ has elapsed from the start of sheet supply, the program proceeds from step S2 to step S6. At step S6, the clutch 54 is turned off, whereupon the feeding operation is once halted. Then, it is determined at step S7 whether the sheet detection gate 56 has been engaged or not. More specifically, it is determined whether the sheet actually reaches the guiding roller pair 27 or not. When it is determined that the gate 56 is engaged, the program proceeds to step S8. At step S8, the sheet is transported toward the image forming unit 5 by the guiding roller pair and other elements.

When it is determined that the gate 56 has not been engaged at step S7, the program proceeds from step S7 to step S9. It is determined at step S9 whether the variable n is equal to or less than "3" or not. When it is determined that the variable n is "3" or less, the program proceeds from step S9 to step S10. At step S10, the variable n is incremented. At step S11, the timer for counting the predetermined time $T_1$ is reset and started again. At step S12, the clutch 54 is turned on again, whereupon sheet-feeding operation is started again in a case of feeding defect (a case where the sheet does not reach the guiding rollers 27 after the predetermined time $T_1$ has elapsed from the start of sheet supply).

When it is determined at step S9 that the variable n is beyond "3" ( more specifically, that the feeding operation has been performed three times), the program proceeds from step S9 to step S13. At step S13, the LED indicating the paper jam and time to replace a feeding roller in the LED display 66 are lit. In addition, in the position display 67, the LED corresponding to the cassette storing the corresponding sized sheets is lit. At step S14, the operation of the copying machine body 1 is halted and the program is completed.

In this embodiment, the feeding operation is performed three times when the feeding defect is generated and the paper jam is not displayed until the operation is performed four times. Thus, the machine is not unnecessarily halted even when the feeding defect is generated once, reducing the number of halting operation of the machine.

Embodiment II

Figure 6:
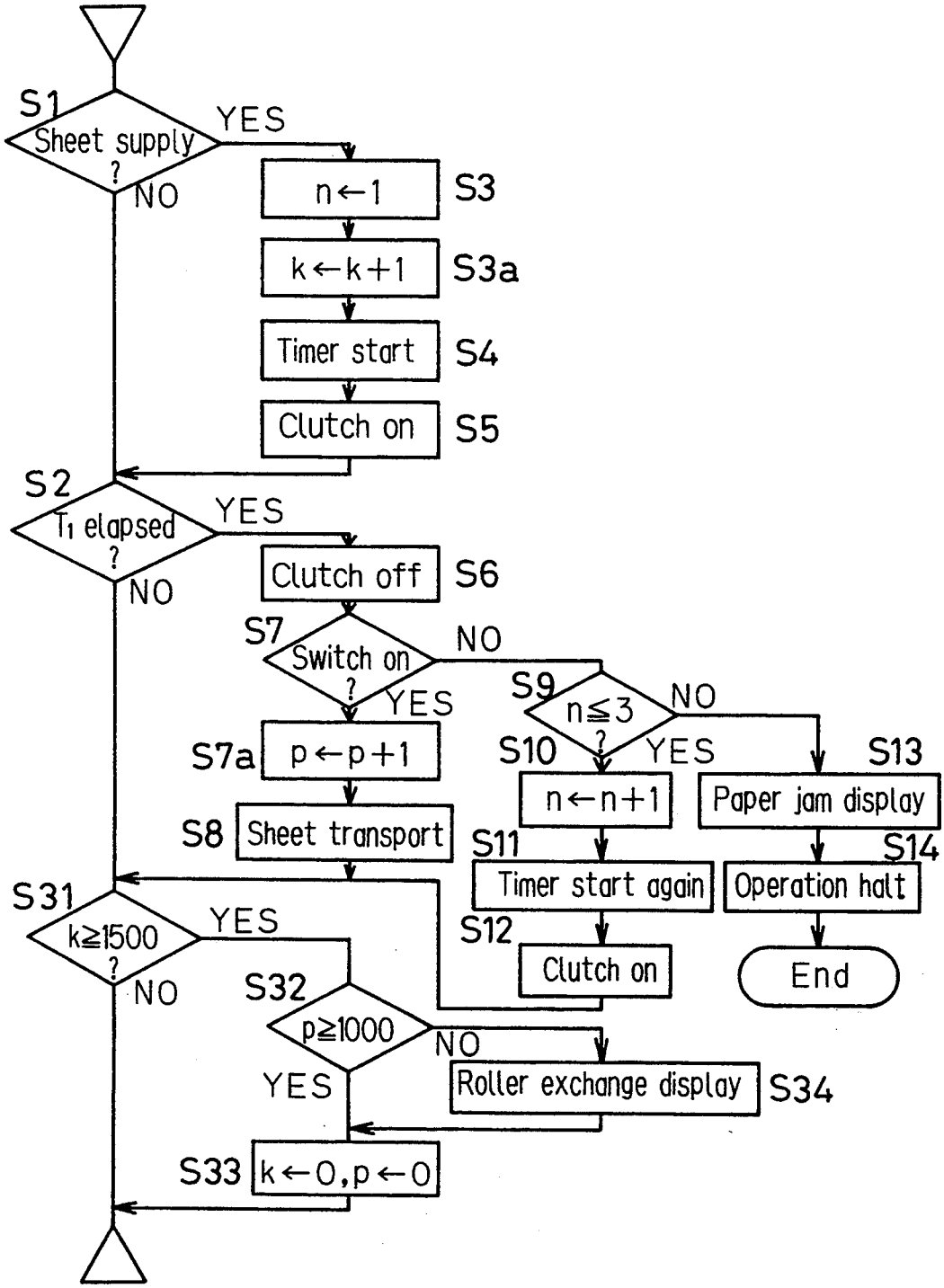
FIG. 6 is a control flow chart corresponding to FIG. 5, according to an embodiment II of the present invention.

FIG. 6 shows all embodiment for detecting a life of the feeding roller. Since this embodiment is the same as the embodiment I except for a process which will be described later, a description other than that process is omitted. In addition, in FIG. 6, the same references are allotted to the same steps as in FIG. 5.

Referring to FIG. 6, the variable n is set to "1" at step S3, and then the program proceeds to step S3*a*. At step S3*a*, a variable k is incremented, and then the program proceeds to step S4. The variable k is for counting the number of operations of the clutch 54, which is set to "0" at initialization.

Wherein it is determined at step S7 that the gate 56 is turned on, the program proceeds to step S7*a*. At step S7*a*, a variable p is incremented. The variable p is for counting how many times the gate 56 is turned on, which is set to "0" at initialization. According to the variable p, the number of sheets actually reaching the image forming unit 5 call be determined.

It is determined at step S31 whether the variable k is equal to or more than 1500 or not (that is, whether the clutch 54 is operated 1500 times or more, or not). Wherein the variable k is less than 1500, the program proceeds to succeeding general step. Alternatively, wherein the variable k is 1500 or more, the program proceeds to step S32.

It is determined at step S32 whether the variable p is equal to or more than 1000 or not (that is, whether the gate 56 was engaged 1000 times or more, or not). Wherein the variable p is 1000 or more, it is determined that the feeding roller 18 can be still used, and then the program proceeds to step S33. At step S33, the variable p and the variable k are reset to "0". Wherein the variable p is less than 1000, it is determined that the feeding roller 18 should be replaced, and then the program proceeds to step S34, in which "replace roller" is displayed in the LED display 66. Then, the program proceeds to step S33, in which the variables p and k are initialized.

According to the above embodiment of the present invention, each time the clutch 54 is operated 1500 times, the actual number of supplied sheets (the number of times the gate 56 has been engaged by the sheets) is detected, and this number is compared to the number of operations of the clutch 54. Then, when the number of supplied sheets is considerably less than the number of the feeding operations, it is determined that the feeding roller is worn out and should be replaced.

[Modifications]

(a) The process after step S13 in the above embodiment of the present invention may be as follows.

Figure 7:
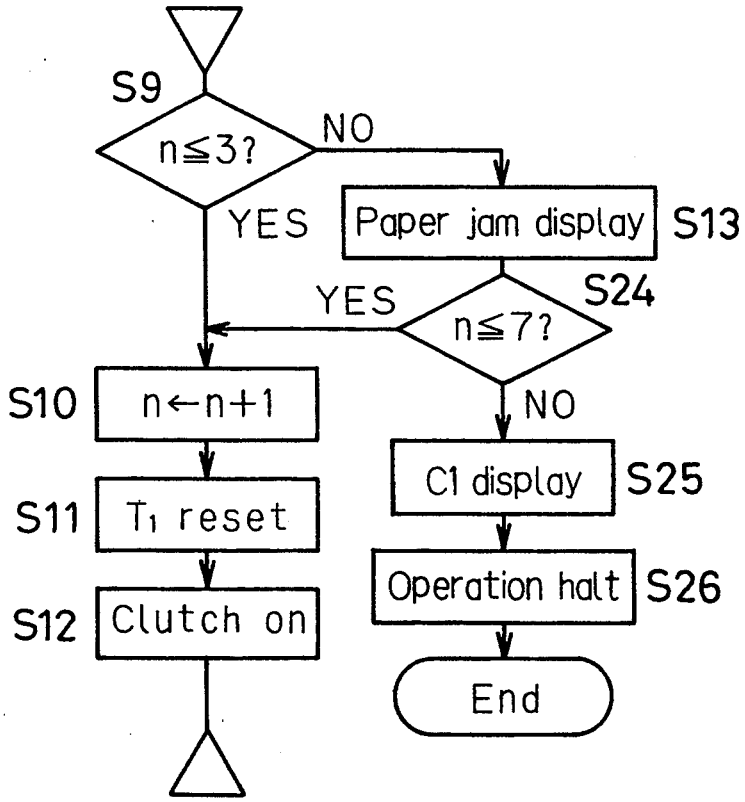
FIG. 7 is a control flow chart corresponding to FIG. 5, according to another embodiment of the present invention.

Referring to FIG. 7, it is determined at step S24 whether the variable n is equal to or less than "7" or not after the paper jam is displayed at step S13. Wherein the variable n is more than "7" (that is, wherein the feeding operation has been done eight times), the program proceeds to step S25, in which a code "C1" of the service man call indicating that the feeding unit 11 is defective, for example is displayed in the numeral display 65, and then the operation is halted at step S26.

According to the above embodiment of the present invention, the device detects the severity of the defect such that in the example of a slight defect where the feeding operation must be performed seven times or less, then only the paper jam and the time to replace a feeding roller are displayed in the LED display 66 at step S13. On the other hand, in the example of a serious defect such that the supplying operation must be performed more than seven times, then a service man call code is displayed in the numeral display 65 and the operation is halted.

(b) Instead of the copying machine, the present invention may be applied to other image forming apparatus such as laser printers or facsimile terminals.

Various details of the invention may be changed without departing from its spirit not its scope. Furthermore, the foregoing description of the embodiments according to the present invention is provided for the purpose of illustration only, and not for the purpose of limiting the invention as defined by the appended claims and their equivalents.

What is claimed is:

1. A sheet forwarding apparatus for feeding a sheet from a stack of sheets in a sheet-storing means to an image forming unit of an image forming apparatus, comprising:

sheet-forwarding means for forwarding sheets one by one from said sheet-storing means to an image forming unit;

operation counter means for counting a number of operations of said sheet-forwarding means;

instructing means for instructing said sheet-forwarding means to start a sheet forwarding operation;

detecting means for detecting whether a sheet is forwarded from said sheet-storing means;

detection counter means for counting the number of times forwarding of a sheet is detected by said detecting means;

controlling means for operating said sheet-forwarding means a first predetermined number of times after said instructing means has instructed a start of the sheet forwarding operation or until said detecting means detects that a sheet is forwarded, whichever occurs earlier;

error processing means for performing an error process when said detecting means does not detect that a sheet is forwarded after the sheet forwarding operation of said sheet-forwarding means is repeated said first predetermined number of times; and determining means for determining a state of said sheet-forwarding means by comparing an operation count of said operation counter means with a detection count of said detection counter means.

2. A sheet forwarding apparatus according to claim 1, wherein said detecting means includes a sheet detection gate disposed in said sheet-forwarding means.

3. A sheet forwarding apparatus according to claim 1, further including an operation panel and wherein said instructing means includes a print key disposed in said operation panel.

4. A sheet forwarding apparatus according to claim 3, wherein said operation panel includes a display, and said error processing means performs an indicating process for indicating an error in said display.

5. A sheet forwarding apparatus according to claim 4, wherein said error processing means performs a halting process for halting operation of said image forming apparatus.

6. A sheet forwarding apparatus according to claim 5, wherein said error processing means performs the error process when said detecting means does not detect that a sheet is forwarded after the operation of said sheet-forwarding means is performed four times.

7. A sheet forwarding apparatus according to claim 1, further including a display, wherein said error processing means performs an indicating process for indicating in said display when a paper jam occurs and when a feeding roller is worn-out.

8. A sheet forwarding apparatus according to claim 7, wherein said error processing means performs a halting process for halting operation of said image forming apparatus.

9. A sheet forwarding apparatus according to claim 8, wherein said error processing means performs the error process when said detecting means has not detected that a sheet is forwarded after four operations of said sheet-forwarding means.

10. A sheet forwarding apparatus according to claim 9, wherein said error processing means indicates a paper jam and a worn-out feeding roller in said display when said detecting means has not detected that a sheet is forwarded after fourth, fifth and sixth operations of said sheet-forwarding means, and said error processing means halts an image forming operation of said image forming apparatus when said detecting means has not detecting a sheet after seven operations of said sheet-forwarding means.

11. A sheet forwarding apparatus according to claim 10, wherein said determining means determines that a feeding roller of said sheet-forwarding means is worn-out when said operation counter means reaches a second predetermined number and a detection count of said detection counter means is less than a third predetermined number at a same time.

12. A sheet forwarding apparatus according to claim 1 in combination with sheet-storing means for storing a stack of sheets.

13. A sheet forwarding apparatus according to claim 12, wherein said sheet-storing means includes at least one feeding cassette.

14. A sheet forwarding apparatus according to claim 13, wherein said sheet-forwarding means includes a feeding roller for feeding an uppermost sheet from said feeding cassette, a separating roller pair for separating a sheet fed by said feeding roller from other sheets, a transport path for guiding a separated sheet, and a guiding roller pair for guiding a separated sheet along the transport path.

15. A sheet forwarding apparatus according to claim 14, wherein said detecting means Includes a gate disposed below said guiding roller pair in the transport path of said sheet-forwarding means.

16. A sheet forwarding apparatus according to claim 15, wherein said controlling means includes a clutch connected to said separating roller pair.

17. A sheet forwarding apparatus according to claim 16, wherein said operation counter means counts a number of operations of said clutch.

18. A sheet forwarding state detecting apparatus for detecting a sheet forwarded to an image forming apparatus from a stack of sheets in a sheet storing means, comprising:

sheet-forwarding means for forwarding sheets one by one from a sheet-storing means to an image forming unit;

operation counter means for counting a number of operations of said sheet-forwarding means;

detecting means for detecting whether a sheet is forwarded from a sheet-storing means;

detection counter means for counting a number of times a sheet is detected by said detecting means; and determining means for determining a state of said sheet-forwarding means by comparing an operation count of said operation counter means with a detection count of said detection counter means.

19. A sheet forwarding state detecting apparatus according to claim 18, in combination with sheet-storing means for storing a stack of sheets.

20. A sheet forwarding state detecting apparatus according to claim 19, wherein said sheet-storing means includes at least one feeding cassette.

21. A sheet forwarding state detecting apparatus according to claim 20, wherein said sheet-forwarding means includes a feeding roller for feeding an uppermost sheet from said feeding cassette, a separating roller pair for separating one sheet feed by said feeding roller from other sheets, a transport path for guiding a separated sheet, and a guiding roller pair for guiding a separated sheet along the transport path.

22. A sheet forwarding state detecting apparatus according to claim 21, wherein said determining means determines that the feeding roller is worn out when an operation count of said operation counter means reaches a first predetermined number and a detection count of said detection counter means is less then a second predetermined number at a same time.

* * * * *